US010202840B2

(12) United States Patent
Dwars

(10) Patent No.: US 10,202,840 B2
(45) Date of Patent: Feb. 12, 2019

(54) STEERABLE DRILLING METHOD AND SYSTEM

(71) Applicant: SHELL OIL COMPANY, Houston, TX (US)

(72) Inventor: Sicco Dwars, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 246 days.

(21) Appl. No.: 15/109,370

(22) PCT Filed: Dec. 19, 2014

(86) PCT No.: PCT/EP2014/078683
§ 371 (c)(1),
(2) Date: Jun. 30, 2016

(87) PCT Pub. No.: WO2015/101518
PCT Pub. Date: Jul. 9, 2015

(65) Prior Publication Data

US 2016/0326864 A1 Nov. 10, 2016

(30) Foreign Application Priority Data

Jan. 2, 2014 (EP) ..... 14150039

(51) Int. Cl.
*E21B 47/024* (2006.01)
*E21B 47/18* (2012.01)
(Continued)

(52) U.S. Cl.
CPC ..... *E21B 47/024* (2013.01); *E21B 7/062* (2013.01); *E21B 7/068* (2013.01); *E21B 44/04* (2013.01); *E21B 47/18* (2013.01)

(58) Field of Classification Search
CPC ..... E21B 47/024; E21B 45/00; E21B 4/00; E21B 44/04; E21B 47/18; E21B 44/08; E21B 7/068; E21B 7/062
See application file for complete search history.

(56) References Cited

U.S. PATENT DOCUMENTS 4,485,879 A 12/1984 Kamp et al.
5,091,644 A 2/1992 Minette
(Continued)

FOREIGN PATENT DOCUMENTS

WO 20110081673 7/2011
WO 20110130159 10/2011
WO 20140147118 9/2014

OTHER PUBLICATIONS

International Search Report and Written Opinion received for PCT Patent Application No. PCT/EP2014/078683, dated Nov. 9, 2015, 8 pages.

*Primary Examiner* — Michael R Wills, III

(57) ABSTRACT

A method for steerable drilling is presented herein. The method includes inducing a drill string rotation modulation system to modulate a rotational speed of a drill string during each revolution of the drill string. The method also includes inducing a Measuring-While-Drilling device (MWD) to transmit repeatedly measured orientations of a Bottom Hole Assembly (BHA) between the drill string and the drill bit to the drill string rotation modulation system to steer a drill bit with a tilted toolface in a deviated drilling direction. The MWD divides each revolution of the BHA into a plurality of angular intervals, and transmits average percentages of time that the BHA rotates through the angular intervals to the drill string rotation modulation system to provide the modulation system with information about an angular orientation of the deviated drilling direction.

19 Claims, 3 Drawing Sheets

(51) Int. Cl.
*E21B 44/04* (2006.01)
*E21B 7/06* (2006.01)

(56) References Cited

U.S. PATENT DOCUMENTS

| | | | | |
|---|---|---|---|---|
| 6,215,120 | B1 | 4/2001 | Gadeken et al. | |
| 6,405,808 | B1 | 6/2002 | Edwards et al. | |
| 7,152,696 | B2 * | 12/2006 | Jones | E21B 7/04 175/61 |
| 7,588,100 | B2 | 9/2009 | Hamilton | |
| 7,766,098 | B2 | 8/2010 | Farley | |
| 9,290,995 | B2 * | 3/2016 | Boone | E21B 7/24 |
| 9,932,811 | B2 | 4/2018 | Dwars et al. | |
| 2009/0057018 | A1 | 3/2009 | Farley | |
| 2009/0065258 | A1 | 3/2009 | Hamilton | |

* cited by examiner

STEERABLE DRILLING METHOD AND SYSTEM

CROSS-REFERENCE TO RELATED APPLICATIONS

The present application is a National Stage (§ 371) of International Application No. PCT/EP2014/078683, filed Dec. 19, 2014, which claims priority from European Application No. 14150039.7, filed Jan. 2, 2014, the disclosures of each of which are hereby incorporated by reference in their entirety.

BACKGROUND OF THE INVENTION

The invention relates to a steerable drilling method and system for drilling a borehole into an earth formation. The method and system may be used for directional drilling underground boreholes for use as wellbores for the production of hydrocarbons and/or for injecting stimulation fluids into a hydrocarbon fluid containing reservoir formation.

Boreholes are typically drilled using rotary drilling systems with a rotating drill bit and drill string assembly which is rotated by a rotary top drive system at the earth surface. Alternatively or in addition, a downhole drilling motor may be arranged in a Borehole Bottom Assembly (BHA) near the drill bit to rotate the drill bit relative to the drill string.

The drill bit may be steered by positioning a toolface of the the drill bit in a tilted position on the borehole bottom that by both activating the rotary drive and downhole motor the drill bit will make a two superposed rotating motions and drill vertical or straight sections, whereas if the rotary drive rotation is temporary interrupted curved borehole sections may be drilled with a selected angular orientation. In this way a borehole trajectory is drilled with both curved and straight vertical, inclined and/or horizontal sections.

The drill string may be up to 10 kilometers long and comprise 10-15 meters long drill pipe sections that are interconnected by threaded couplings.

The top drive system may provide torque to the drill string to rotate the drill string, which may be twisted so that the top drive has made up to 30 revolutions before the drill bit start to rotate if it is up to 10 kilometers long and may trigger a stick-slip motion of the drill bit, whereby the drill string twist and torque may dynamically and sinusoidally cycle between minimum and maximum values. The top drive system may include a top drive swivel or a rotary table. The drill string transmits the rotational motion to the drill bit. Generally the drill string also transmits drilling fluid to the drill bit to provide cooling to the drill bit, to transport drill cuttings to surface, and for other useful purposes. In order to drill curved wellbore sections that are preceded or followed by straight sections, it has been practised to apply a drill string provided with a downhole motor driving the drill bit, in combination with a rotary drive at surface, whereby the drill bit has an inclined or tilted toolface so that the drill bit is positioned in an inclined or tilted position relative to a central axis of the borehole and borehole bottom.

Rotary Steerable Systems (RSS) are available to the industry for the purpose of steering the drill bit in order to drill a planned well trajectory. Most prior art RSS directional drilling systems use some form of downhole mechanical actuation, such as for example orientation selective force against wellbore formation, by modulating the drilling fluid flow through the mud motor, or by modulating mud flow in bit nozzles. These mechanically actuated directional drilling systems suffer from wear and tear, and often fail under the high temperature, high pressure, high vibrations downhole environment. This leads to expensive pulling of the entire drill string to repair or replace the failed mechanical components at surface.

U.S. Pat. No. 4,485,879 relates to a method for directional drilling of boreholes in subsurface formations by a downhole motor at a lower end of a drill string. The downhole motor rotates a drill bit while a predetermined weight is applied on the drill bit causing the normally-straight axis of the downhole motor to become bent. Simultaneously the drill string is rotated over periods of time that are preceded and followed by selected periods during which the drill string is not rotated. A drawback of this method relates to the friction forces between the drill string and the borehole wall, which are relatively high during periods of time that the drill string is not rotated.

WO-2011130159-A2 discloses a method of controlling a direction of drilling of a drill bit used to form an opening in a subsurface formation includes varying a speed of the drill bit during rotational drilling such that the drill bit is at a first speed during a first portion of the rotational cycle and at a second speed during a second portion of the rotational cycle, wherein the first speed is higher than the second speed, and wherein operating at the second speed in the second portion of the rotational cycle causes the drill bit to change the direction of drilling. This publication also discloses estimating toolface of a bottom hole assembly between downhole updates during drilling in a subsurface formation including encoding a drill string, running the drill string in the formation in a calibration mode to model drill string windup in the formation during drilling operations, measuring a rotational position of the drill string at the surface of the formation, and estimating the toolface of the bottom hole assembly based on the rotational position of the drill string at the surface and the drill string windup model.

U.S. Pat. No. 7,766,098 and U.S. Pat. No. 7,588,100 disclose a system and a method for steering the direction of a borehole advanced by cutting action of a rotary drill bit by periodically varying the rotation speed of the drill bit, either by varying the rotation speed of the motor or by varying the rotation speed of the drill string. It is a drawback of the know system that the speed variation response at the drill bit generally differs considerably from the rotational speed variation at surface due to torsional vibrations and windup of the drill string, particularly for deeper boreholes, resulting in lack of control of the drilling direction.

International patent application WO2011/081673 discloses a method of bit steering by cyclically increasing a rotational speed of a drill bit when an axis of the drill bit is oriented in a desired azimuthal direction relative to a drill string axis.

US patent application US2009/0057018 discloses another directional drilling system wherein an inclined drill bit is steered by periodically varying the rotational speed of the drill string and/or of a downhole drilling motor in the BHA, which is equipped with Measuring While Drilling (MWD) BHA orientation Sensors US patent application US2009/0065258 discloses a directional drilling method wherein a the rotary speed of a drill string is varied during each revolution and substantially similarly for each of a plurality of revolutions to induce an inclined drill bit at a bottom of the drill string to drill deviated borehole sections with a selected orientation, which is measured using a Measuring While Drilling (MWD) orientation sensing system.

Known MWD systems comprise inclinometers and/or magnetic field detectors to provide a three-dimensional orientation of the BHA and drill bit relative to the earth gravitational and magnetic fields and/or relative to a drill string axis, but do not yet indicate average percentages of time that the BHA rotates through the angular intervals, which is a relevant characteristic for the bit steering process.

There is a need for an improved steerable method and system for drilling a borehole, which overcomes the drawbacks of the prior art and avoids the need for a drill string windup model by monitoring percentages of time that the BHA rotates through the angular intervals, which is a relevant characteristic for the bit steering process.

SUMMARY OF THE INVENTION

In accordance with the invention there is provided a steerable drilling method for drilling a borehole into an earth formation, the method comprising:

inducing a drill string rotation modulation system to modulate a rotational speed of a drill string during each revolution of the drill string;

inducing a Measuring While-drilling Device (MWD) to transmit repeatedly measured orientations of a Bottom Hole Assembly (BHA) between the drill string and the drill bit to the drill string rotation modulation system to steer a drill bit with a tilted toolface in a deviated drilling direction;

characterized in that the MWD divides each revolution of the BHA into a plurality of angular intervals, and one transmits average percentages of time that the BHA rotates through the angular intervals to the drill string rotation modulation system to provide the modulation system with information about an angular orientation of the deviated drilling direction.

By transmitting average percentages of time that the BHA rotates through angular intervals to the drill string rotation modulation system to provide the modulation system with information about an angular orientation of the deviated drilling direction, it is achieved that there is no longer a need to estimate the static and dynamic amount of drill string twist up from torque and/or drag measurements plus calibrated models. Instead it is determined on a statistical basis what the consequences of the twist up and vibrations are. I.e., a phase offset and noise between the orientation of the drive system at surface and the BHA orientation, which may be represented by a number in the range of 0-360 degrees for static orientation, and suitable numbers for noise and loss of focus or loss of modulation intensity.

In an embodiment, data relating to the measured average percentages that the BHA rotates through the selected angular intervals are temporarily stored in an computer device embedded in the MWD, and the MWD transmits signals representing the measured data at selected time intervals, for example intervals between 1 to 10 minutes. This may be done using a mud pulse telemetry system included in the BHA. Alternatively, an electromagnetic or acoustic telemetry system or wired drill pipe may be used. The MWD may measure the orientation of the BHA at a rate of between 3 to 60 times per second.

Suitably each revolution of an upper portion of the drill string is also divided into a plurality of angular sections or intervals, wherein modulation of the rotational speed is characterised by a primary function indicating average percentages of time that the upper drill string portion rotates through the angular sections or intervals, whilst a secondary function may indicate average percentages of time that the BHA rotates through the angular intervals and the step of. Said primary and secondary functions may be compared with each other, and the modulation of the rotational speed of the drill string may be adjusted in dependence of a result of said comparison.

The primary function may suitably be represented by statistical parameters A, B and C, wherein parameter A defines a rotational position of the upper drill string portion at which the primary function is at a minimum, parameter B defines a difference between said minimum and a maximum of the primary function, and parameter C defines a rotation angle range of the upper drill string portion in which the primary function has a lower average value than in a remaining rotation angle of the upper drill string portion.

Furthermore, the secondary function may suitably be represented by statistical parameters P, Q and R, wherein parameter P defines a rotational position of the BHA at which the secondary function is at a minimum, parameter Q defines a difference between said minimum and a maximum of the secondary function, and parameter R defines a rotation angle range of the BHA in which the secondary function has a lower average value than in a remaining rotation angle of the BHA.

These parameters are advantageously used to adjust modulation of the rotary speed of the upper drill string portion during each revolution. For example, parameter A may be adjusted in dependence of parameter P, parameter B may be adjusted in dependence of parameter Q, and/or parameter C may be adjusted in dependence of parameter R.

With suitable surface drive speeds of between 18 to 180 RPM (revolutions per minute), the BHA orientation may be measured at a rate larger than 10 updates per revolution, thus providing about 180 to 1800 samples per minute, i.e. 3 to 30 updates per second. In one embodiment the embedded computer system, which may be a dedicated MWD section in the BHA, measures and stores instantaneous toolface orientations relative to inclination and earth magnetic field at a rate of 30 updates per second. Statistical summaries, represented by parameters P, Q and R, are computed and transmitted to surface at a much slower rate.

To accurately control the drilling trajectory, the orientation of the bottom hole assembly is preferably measured in three dimensions by the measurement while drilling device (MWD). In one embodiment, the MWD is a modified prior art device adapted to have an increased sampling rate and to perform the necessary statistical calculations.

The signals representing the statistical parameters P, Q and R are advantageously transmitted to surface using a mud pulse telemetry system.

In a further embodiment the upper end of the drill string has a first mechanical impedance and the drive system (i.e. top drive or rotary table and related equipment) has a second mechanical impedance differing from the first mechanical impedance such that standing torsional waves may occur in the drill string, and the method comprises adjusting the mechanical impedance of the drive system in an upper frequency band of the torsional waves so as to minimise said difference. In this manner it is achieved that reflection of the torsional waves at surface, i.e. at the interface with the drive system, is inhibited so that the undesired phenomenon of stick-slip whereby alternating cycles of high speed rotation and complete standstill of the drill bit occur, is prevented.

A suitable method of adjusting the mechanical impedance of the drive system to mitigate torsional vibrations in a tool string is described in European patent application number 13179337.4, which method is mutatis mutandis applicable to the method according to the present invention and then comprises the steps of:

instructing the drive system to rotate the drill string at a set rotational speed ($\Omega_r$);

determining a rotational speed ($\omega_r$) of the drill string;

determining a torque (T) at or near the interface between the drill string and the drive system;

determining a drill string impedance ($\zeta$) of a section of the drill string adjacent said interface;

calculating a rotation correction signal using the determined torque (T) multiplied by the determined drill string impedance ($\zeta$);

correcting the set rotational speed ($\Omega_r$) using the rotation correction signal to provide a corrected set rotational speed ($\Omega_{r,cor}$) signal;

subtracting the measured rotational speed ($\omega_r$) from the corrected set rotational speed signal to provide a twice corrected set rotational speed ($\Omega_{r,2cor}$) signal to the drive system.

The step of correcting the set rotational speed may suitably include multiplying the set rotational speed by a predetermined factor, and subtracting the rotation correction signal from the multiplied set rotational speed ($2*\Omega_r$) to provide a corrected set rotational speed ($\Omega_{r,cor}$) signal. The predetermined factor may be, for example, 2.

In order to force the drill string to eventually rotate at the desired set point RPM, a further correction may be applied to the twice corrected set rotational speed by not matching the drive system output impedance to the drill string impedance for timescales much longer than the longest expected stick-slip period, which may be between about 1 and 10 seconds. The drill string rotational speed may be adjusted to the desired set point speed, irrespective of the static torque that needs to be supplied by the drive system.

The method according to the invention may be used to steer the drill bit to a drilling target within a hydrocarbon fluid containing formation and upon reaching the drilling target the borehole may be converted into a hydrocarbon fluid production well from which hydrocarbon fluid is produced.

In accordance with the invention there is furthermore provided a steerable borehole drilling system comprising:

a drill string rotation modulation system configured to modulate a rotational speed of a drill string during each revolution thereof;

a Measuring While Drilling Device (MWD) configured to transmit repeated measurements of an orientation of a Bottom Hole Assembly (BHA) between a lower end of the drill string and a drill bit with a tilted toolface orientation to the modulation system to steer the drill bit in a desired direction;

characterized in that the MWD is configured to divide each revolution of the BHA into a plurality of angular intervals and to determine average percentages of time that the BHA rotates through the angular intervals to transmit information about the drill bit steering direction to the modulation system.

These and other features, embodiments and advantages of the method and system according to the invention are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects. Objects and other features depicted in the figures and/or described in this specification, abstract and/or claims may be combined in different ways by a person skilled in the art.

BRIEF DESCRIPTION OF THE DRAWINGS

The invention will be described hereinafter in more detail and by way of example with reference to the accompanying schematic drawings in which.

DETAILED DESCRIPTION OF DEPICTED EMBODIMENTS

Figure 1:
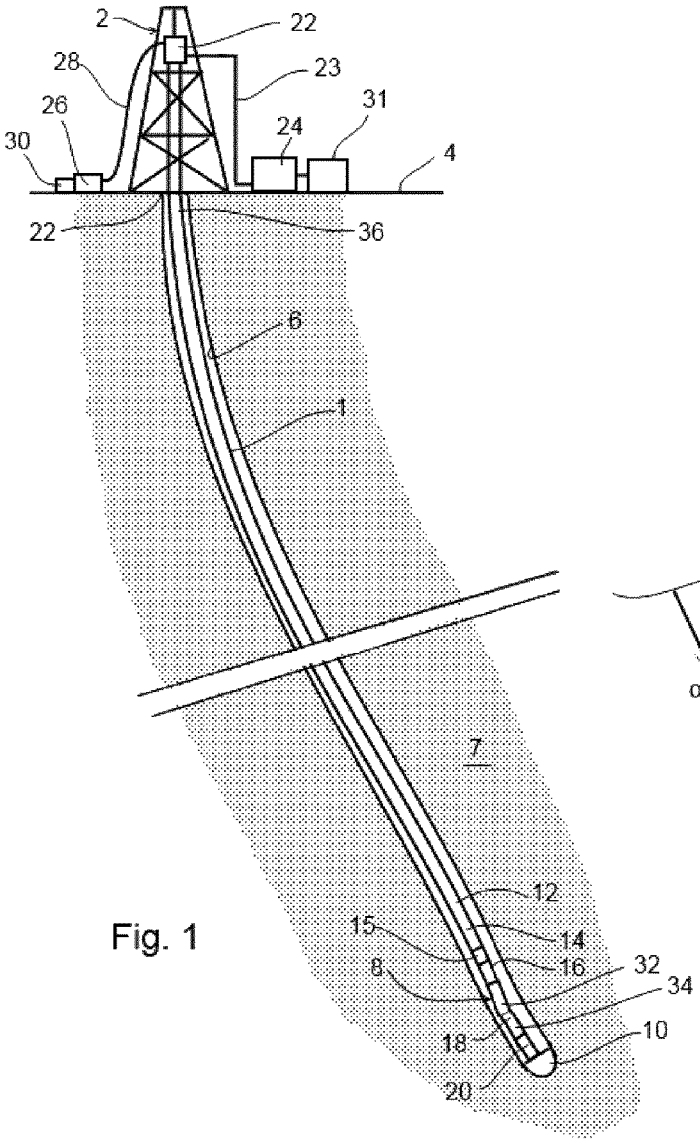
FIG. 1 shows a drilling assembly for use in an embodiment of the method of the invention.

In the following detailed description of depicted embodiments and in the accompanying figures, like reference numerals relate to like components.

When used in this specification and claims the expression "toolface direction" refers to a direction orthogonal to the toolface of the drill bit. This direction generally corresponds with the drilling direction of the drill bit when the drill bit is rotated about its central longitudinal axis.

Figure 2:
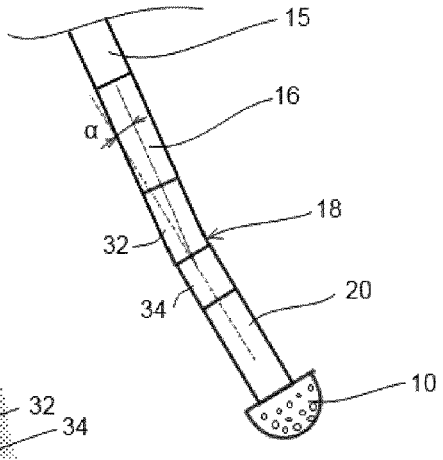
FIG. 2 shows a lower portion of the drill string in more detail.

FIGS. 1 and 2 show a drill string 1 extending from a drilling rig 2 at the earth surface 4 into an underground wellbore 6 being drilled into a subsurface earth formation 7. The drill string 1 comprises a series of interconnected drill pipes and is connected at a lower end thereof to a Bottom Hole Assembly (BHA) 8 comprising a drill bit 10. The BHA may include one or more of: Relatively heavy drill collars 12, a measurement while drilling (MWD) unit 14, an embedded computer device 15, a mud pulse telemetry device 16, a bent sub 18 and a downhole motor 20 for rotating the drill bit 10 relative to the drill string 1. The downhole motor 20 may be a turbine motor or a positive displacement motor. The downhole motor 20 may be of a basic design, and may be operated at a constant speed.

The drill string 1 is at its upper end connected to a drive system, typically a top drive 22, arranged to rotate the drill string about a longitudinal axis thereof. The top drive 22 is connected via connection 23 to a computer control device 24 adapted to modulate the speed of the top drive during each revolution. Instead of the top drive 22, any suitable drive system can be applied to rotate the drill string 1, for example a Kelly drive or rotary table system. A mud pump 26 is fluidly connected to the drill string 1 via a conduit 28 for pumping drilling fluid into the drill string 1 in order to drive the downhole motor 20. A control system 30 is provided at the drilling rig 2 for controlling operation of the mud pump 26. Furthermore, a computer system 31 is provided to control the direction of drilling, based on a desired drilling trajectory loaded into the computer and downhole measurement data as described hereinafter.

The MWD unit 14 includes in conventional manner three orthogonal magnetometers (not shown) and three orthogonal accelerometers (not shown) to measure the three components of the gravity vector and the Earth magnetic field vector. Other suitable sensors such as gyroscopes may be used instead.

The embedded computer device 15, which may be integrally formed with the MWD device 14, is adapted to perform certain statistical calculations on the data measured by the MWD device 14, as will be explained in more detail hereinafter.

The mud pulse telemetry device 16 is provided with valves to modulate the flow of drilling fluid in the interior of the drill string 1 so as to generate pressure pulses in the drill string that propagate up the column of fluid inside the drill string. The pressure pulses are detected by pressure transducers at the surface.

The bent sub 18 has an upper tubular portion 32 and a lower tubular portion 34 that extends inclined relative to the upper tubular portion at inclination angle $\alpha$ (FIG. 2). The downhole motor 20 with the drill bit 10 is connected to, and aligned with, the lower tubular portion 34 of the bent sub. As a result the tilted toolface direction of the drill bit 10 is inclined at angle $\alpha$ relative to the central longitudinal axis of the upper tubular portion 32 and drill collars 12. Instead of using a bent sub and a straight downhole motor, a downhole motor with a bent housing may be used.

Figure 3:
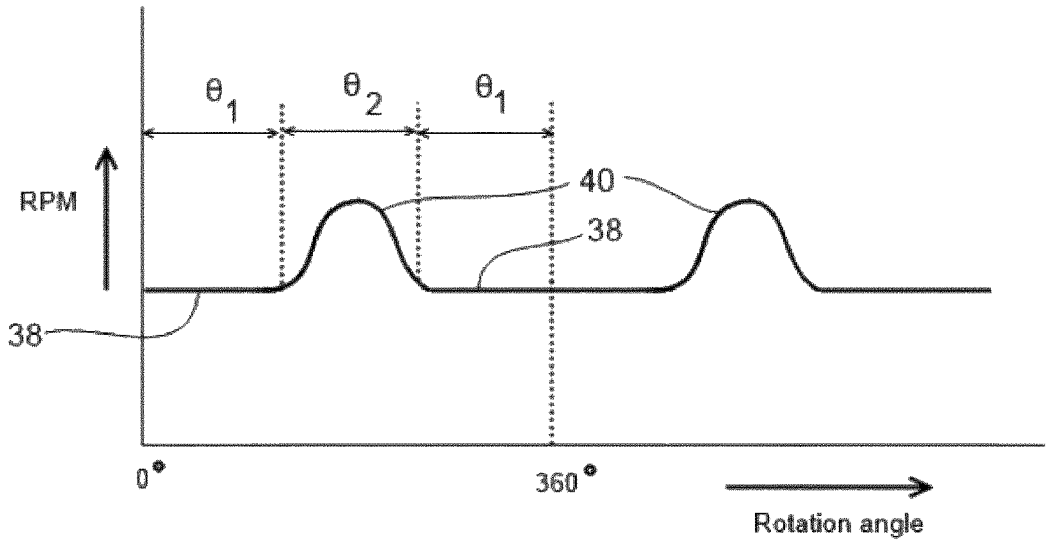
FIG. 3 shows a diagram representing drill string rotary speed at surface versus rotation angle.

FIG. 3 shows a diagram of the rotary speed of an upper portion 36 (FIG. 1) of the drill string 1 expressed in revolutions per minute (rpm), versus rotation angle of the upper drill string portion 36. During each revolution of the top drive 22, the speed of the top drive 22 is modulated by the computer control device 24 so that the upper drill string portion 36 rotates at a first speed 38 during a first angular interval $\theta_1$ of the revolution, and at a second speed 40 during a second angular interval $\theta_2$ of the revolution, wherein the first speed is lower than the second speed. Note that in FIG. 3 the interval $\theta_1$ is indicated twice, but in fact it is one interval that repeats every 360 degrees, and is only interrupted by interval $\theta_2$ that may or may not overlap the lapse transition 360 to 0 degrees.

Figure 4:
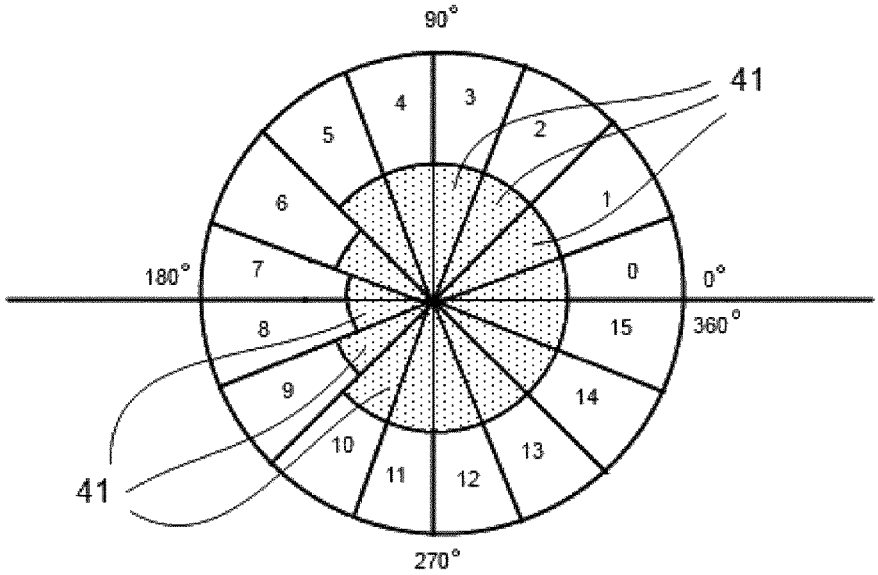
FIG. 4 shows a spider diagram indicating percentages of time that a point on the drill string rotates through angular sections of one revolution.

FIG. 4 shows a spider diagram representing one revolution of the upper drill string portion 36, divided into uniform angular sections numbered 0-15. In each section 0-15, an average percentage of time that the upper drill string portion 36 rotates through the angular section is indicated by dotted area 41. The radial size of the dotted area 41 represents said average percentage of time. In the present example each section extends at an angle of 22.5°, whereby the upper drill string portion rotates about 80% of the time of one revolution through sections 0-5 and 10-15, and about 20% of the time of the revolution through sections 6-9.

Figure 5:
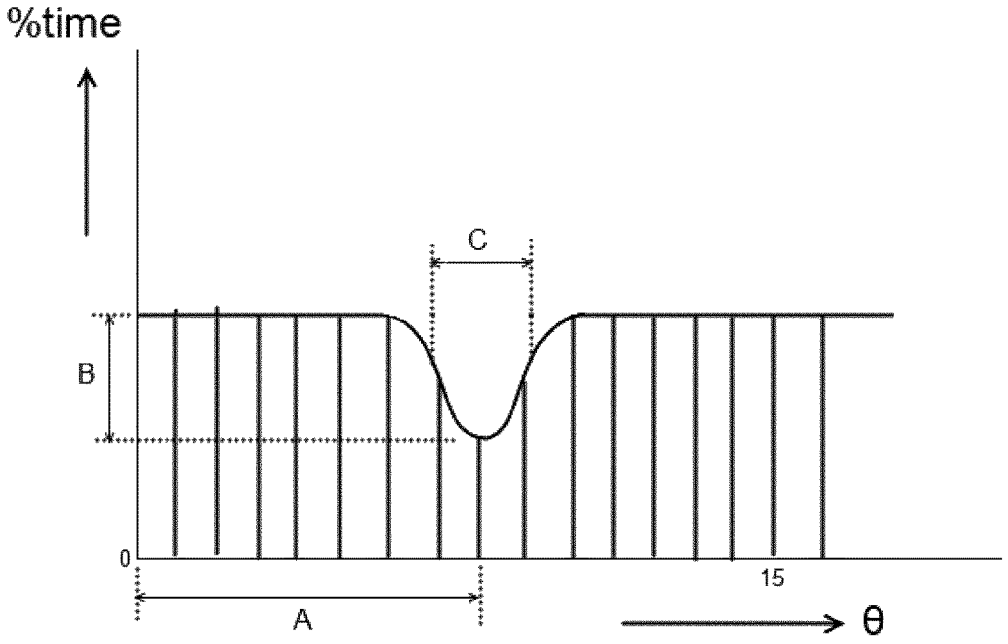
FIG. 5 shows a histogram indicating percentages of time that a point on an upper drill string portion rotates through angular sections of one revolution.

FIG. 5 shows a diagram with horizontal axis representing the rotation angle ($\theta$) of the upper drill string portion 36 expressed in the angular sections 0-15 mentioned above, and vertical axis representing the average percentage of time (% time) that the upper drill string portion 36 rotates through each angular section. The functional relationship between % time and $\theta$ is characterised by parameters A, B and C, wherein parameter A defines a rotational position of the upper drill string portion at which the primary function is at a minimum, parameter B defines a difference between said minimum and a maximum of the primary function, and parameter C defines a rotation angle range of the upper drill string portion in which the primary function has a lower average value than in a remaining rotation angle of the upper drill string portion.

Figure 6:
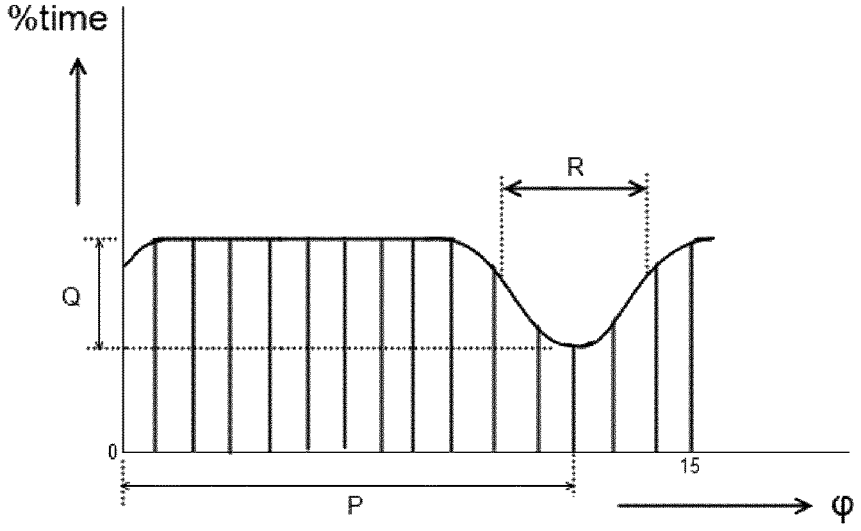
FIG. 6 shows a histogram indicating percentages of time that a point on the BHA rotates through angular sections of one revolution.

FIG. 6 shows a diagram with horizontal axis representing the rotation angle ($\varphi$) of the bottom hole assembly 8 expressed in uniform angular intervals 0-15 of one revolution of the BHA, and vertical axis representing the average percentage of time (% time) that the BHA rotates through each angular interval. The functional relationship between % time and $\varphi$ is characterised by parameters P, Q and R. Herein, parameter P may define a rotational position of the BHA at which the secondary function is at a minimum, parameter Q defines a difference between said minimum and a maximum of the secondary function, and parameter R defines a rotation angle of the BHA in which the secondary function has a lower average value than in a remaining rotation angle of the BHA. In the present example, the number of angular intervals 0-15 of one revolution of the BHA equals the number of angular sections 0-15 of one revolution of the upper drill string portion 36. However, the number of angular intervals suitably can be chosen different from the number of angular sections.

During operation, the drill string 1 may be lowered into the wellbore 6 while the mud pump 26 is operated by control system 30 to pump drilling fluid into the drill string 1 via conduit 28. The mud may drive the downhole motor 20. The drill bit 10 is thereby rotated about its central longitudinal axis which corresponds with the toolface direction that is inclined at inclination angle $\alpha$ relative to the longitudinal axis of the drill string 1 above the bent sub 18. The drill bit 10 will therefore have a tendency to drill in the inclined toolface direction, which would result in drilling of a curved wellbore section if the top drive would be stationary.

Simultaneously with operation of the downhole motor 20, the drill string 1 may be rotated by the top drive 22 about its longitudinal axis. The average speed of the downhole motor 20 and the average speed of the top drive 22 may be roughly the same. The speed of the drill bit 10 is governed by a superposition of the speed of the downhole motor 20 and the speed of the top drive 22 at surface, and can be for example between 30 to 200 RPM. It should be noted that the diametrical size of the drill string is very small relative to its length, therefore the drill string behaves as a slender body in the wellbore 6. In view thereof the longitudinal axis of the drill string 1 may have a curved shape.

The computer control device 24 modulates the speed of the top drive 22 during each drill string revolution in a manner that the upper drill string portion 36 rotates at the first speed 38 (FIG. 3) during the first angular interval $\theta_1$ of each revolution, and at the second speed 40 during the second angular interval $\theta_2$ of the revolution, the first speed being lower than the second speed. The rotary speed of the BHA therefore also modulates during each revolution whereby the rotary speed during a first angular interval $\varphi_1$ of the revolution is lower than during a second angular interval (22 of the revolution. As a result the drill bit 10 spends more time in drilling during the first angular interval $\varphi_1$ than during the second angular interval $\varphi_2$ of the revolution. Consequently the drill bit 10 drills a curved wellbore section that is deviated in the average toolface direction during the first angular interval $\varphi_1$. However due to friction losses of the drill string 1 in the wellbore 6, drill bit cutting resistance, drill string mechanical impedance, and torsional drill string vibrations, the instantaneous rotary speed of the BHA may differ significantly from the instantaneous rotary speed of the upper drill string portion 36. Thus, the angular intervals $\varphi_1$, $\varphi_2$ of the BHA also may differ significantly in size and phase from the angular intervals $\theta_1$, $\theta_2$ of the upper drill string portion 36. In order to be able to adequately control the drilling direction the procedure explained below is followed.

As the drill string 1 is rotated by the top drive 22, the computer system 31 determines the average percentages of time (% time) that the upper drill string portion 36 rotates through each angular section 0-15 as represented in FIG. 5, and calculates the parameters A, B and C of the functional relationship between % time and θ. The computer system 31 may receive the necessary input for these calculations directly from the computer control device 24 that drives the top drive.

At a high rate, for example every 16 millisecond, the MWD unit 14 is operated to measure the orientation of the BHA. The embedded computer device 15 determines for each angular interval 0-15 of the BHA, the average number of measured orientations that are oriented in the respective angular interval. From these average numbers the embedded computer device 15 determines the average percentages of time (% time) that the BHA rotates through each one of the angular intervals 0-15 shown in FIG. 6, and calculates the functional relationship between % time and φ, and also the corresponding parameters P, Q and R. The mud pulse telemetry device 16 transmits mud pulse signals representing the parameters P, Q and R to a pressure transducer (not shown) at surface that detects these signals and passes a voltage signal to computer system 31 that digitises the signals. If desired the measured data can be compressed, for example into 5 bytes of data when using a 0-255 scale and adequate redundancy for transmission error checking and correction.

The calculated parameters P, Q and R provide measures for the average toolface direction of the BHA. Parameter P is a measure for a phase offset between the toolface direction of the drill bit 10 and the direction represented by the rotational position A of the upper drill string portion at which the primary function is at a minimum (FIG. 5). Parameter Q is a measure for the achieved modulation intensity of the BHA, and parameter R is a measure for the focus of the toolface direction. From time to time the achieved drilling trajectory is calculated using the data transmitted to surface by the MWD unit 14, which trajectory is then compared with the planned wellbore trajectory. If the achieved trajectory deviates from the planned trajectory, the drilling direction may be altered by adjusting at least one of the parameters A, B and C. Parameter A may be adjusted to adjust the average toolface direction of the drill bit 10. The parameters B and C may be adjusted to adjust the wellbore curvature (also referred to as build-up rate) during directional drilling. After one or more of the adjustments have been made, drilling proceeds and the parameters P, Q and R are subsequently determined again in the manner described above. If required, further adjustments are made to at least one of parameters A, B and C in order to follow the planned wellbore trajectory.

In an advantageous embodiment, a driller's setpoint RPM is first modulated with the pattern as illustrated in FIG. 3, but without changing the long term average RPM value over many revolutions. Thereafter the setpoint is further modified to achieve the matched drill pipe impedance at surface. The resulting actual top drive (or rotary table) speed is thus a function of the conventional driller's setpoint, the modulation that enables directional drilling as disclosed hereinbefore, and finally an additional modulation that may be applied to cancel out reflections at surface of torsional waves that travel up the drill string, so that standing torsional waves in the drill string cannot materialise, and thus to mitigate torsional vibrations of the drill string.

Thus, the drilling method of the invention involves a measurement and control procedure that eliminates a need for estimating from e.g. torque and drag measurements, plus models, the amount of drill string twist-up. Instead the measurement data from the MWD unit are used to determine what the consequence of such twist-up is, i.e. a phase offset between orientation of the upper drill string portion and orientation of the BHA, which is represented by a number in the range of 0-360 degrees.

Another advantage of the method of the invention relates to reduced friction between the drill string and the wellbore wall in comparison to so-called slide drilling. In the latter method the drill string is not rotated during deviated drilling, and the drill bit is only rotated by the downhole motor. In the method of the invention the drill string is always rotating, therefore the friction forces between drill string and wellbore wall are greatly reduced.

Furthermore, with the method of the invention the drill bit may drill at a much faster rate than with conventional drilling methods since the rotary speed of the drill bit is governed by a superposition of the rotary speed of the top drive and the rotary speed of the downhole motor. In this manner the rotary speed of the drill bit may achieve, for example, between 50 to 200 rpm or even higher.

Thus, the method according to the invention enables directional and also low-tortuosity vertical drilling with a robust downhole system without failure prone mechanical actuators that were necessary in prior art systems and methods. It will thus enable drilling systems that last longer and demand fewer trips per well section drilled. Other than the mud pulse telemetry system (which may be replaced by solid state downhole communication methods), the power source (which may be replaced by batteries) and the downhole motor, an all solid state system is realised. The downhole motor specification may be greatly relaxed upon. The power balance between top drive and downhole motor as energy source can be shifted towards favourable operating conditions, likely leading to more top drive power and less downhole motor power.

Some features and advantages of the steerable oil and/or gas well drilling method are summarized below:

- a drill string rotation modulation system cyclically modulates a rotational speed of a drill string (1) during each revolution thereof to steer a drill bit (10) with a tilted toolface along a curved trajectory, also identified as deviated steering direction;
- a Measuring While Drilling Device (MWD) divides each revolution of a Bottom Hole Assembly (BHA) at a lower end of the drill string (10) into a plurality of angular intervals and transmits average percentages of time that the BHA rotates through the angular intervals to the modulation system thereby providing the modulating system with real time information about the angular orientation of the curved deviated steering direction and obviating a need to provide the modulation system with calibrated models and ongoing torque and/or drill string drag measurements to estimate effects of static and dynamic amounts of drill string twist on the difference between the annular orientations of the upper end of the drill string and the drill bit.

The present invention is not limited to the embodiments as described above, wherein various modifications are conceivable within the scope of the appended claims and the accompanying abstract. Features of respective embodiments described in this specification, claims and abstract may for instance be combined in various ways.

The invention claimed is:

1. A method for steerable drilling a borehole into an earth formation, the method comprising:

inducing a drill string rotation modulation system to modulate a rotational speed of a drill string during each revolution of the drill string;

inducing a Measuring-While-Drilling device (MWD) to transmit repeatedly measured orientations of a Bottom Hole Assembly (BHA) between the drill string and the drill bit to the drill string rotation modulation system to steer a drill bit with a tilted toolface in a deviated drilling direction;

wherein the MWD divides each revolution of the BHA into a plurality of angular intervals, and transmits average percentages of time that the BHA rotates through the angular intervals to the drill string rotation modulation system to provide the modulation system with information about an angular orientation of the deviated drilling direction; and wherein each revolution of an upper portion of the drill string is divided into a plurality of angular sections, and the modulation of the rotational speed defines a primary function indicating average percentages of time that the upper drill string portion rotates through the angular sections.

2. The method of claim 1, wherein BHA comprises a downhole motor that rotates the drill bit about an axis of rotation which is oriented at an acute angle relative to an axis of rotation of the drill string to tilt the toolface orientation of the drill bit within the borehole and the MWD transmits at selected time intervals signals representing the monitored average percentages of time that the BHA rotates through the angular intervals to the drill string rotation modulation system at the earth surface.

3. The method of claim 2, wherein the monitored average percentages of time that the BHA rotates through the angular intervals are temporarily stored in a computer memory of the MWD.

4. The method of claim 2, wherein the MWD transmits the signals to surface at time intervals of between 1 to 10 minutes.

5. The method of claim 2, wherein MWD transmits the signals to surface using a mud pulse telemetry system provided in the BHA.

6. The method of claim 1, wherein the MWD monitors the average percentages of time that the BHA rotates through the angular intervals at a rate of between 3 to 60 times per second.

7. The method of claim 1, wherein the average percentages of time that the BHA rotates through the angular intervals monitored by the MWD defines a secondary function and the method further comprises comparing said primary and secondary functions with each other, and adjusting the modulation of the rotational speed of the drill string in dependence of a result of said comparison.

8. The method of claim 7, wherein the primary function is represented by parameters A, B and C, wherein parameter A defines a rotational position of the upper drill string portion at which the primary function is at a minimum, parameter B defines a difference between said minimum and a maximum of the primary function, and parameter C defines a rotation angle range of the upper drill string portion in which the primary function has a lower average value than in a remaining rotation angle of the upper drill string portion.

9. The method of claim 8, wherein the secondary function is represented by parameters P, Q and R, wherein parameter P defines a rotational position of the BHA at which the secondary function is at a minimum, parameter Q defines a difference between said minimum and a maximum of the secondary function, and parameter R defines a rotation angle range of the BHA in which the secondary function has a lower average value than in a remaining rotation angle of the BHA.

10. The method of claim 9, further comprising the step of using at least one statistical characteristic to adjust modulation of the rotational speed of the drill string comprises adjusting parameter A in dependence of parameter P and/or adjusting parameter B in dependence of parameter Q and/or adjusting parameter C in dependence of parameter R.

11. The method of claim 1, wherein the MWD measures the orientation of the BHA and the drill bit steering direction in three dimensions.

12. The method of claim 1, wherein the method is used to steer the drill bit to a drilling target within a hydrocarbon fluid containing formation and upon reaching the drilling target the borehole is converted into a hydrocarbon fluid production well from which hydrocarbon fluid is produced.

13. A method for steerable drilling a borehole into an earth formation, the method comprising:

inducing a drill string rotation modulation system to modulate a rotational speed of a drill string during each revolution of the drill string;

inducing a Measuring-While-Drilling device (MWD) to transmit repeatedly measured orientations of a Bottom Hole Assembly (BHA) between the drill string and the drill bit to the drill string rotation modulation system to steer a drill bit with a tilted toolface in a deviated drilling direction;

wherein the MWD divides each revolution of the BHA into a plurality of angular intervals, and transmits average percentages of time that the BHA rotates through the angular intervals to the drill string rotation modulation system to provide the modulation system with information about an angular orientation of the deviated drilling direction; and wherein the upper end of the drill string has a first mechanical impedance and the drive system has a second mechanical impedance differing from the first mechanical impedance such that standing torsional waves may occur in the drill string, and the method further comprises adjusting a mechanical impedance of the drive system in an upper frequency band of the torsional waves to minimize said difference by:

instructing the drive system to rotate the drill string at a set rotational speed ($\Omega_r$);

determining a rotational speed ($\omega_r$) of the drill string;

determining a torque (T) at or near the interface between the drill string and the drive system;

determining a drill string impedance ($\zeta$) of a section of the drill string adjacent said interface;

calculating a rotation correction signal using the determined torque (T) multiplied by the determined drill string impedance ($\zeta$);

correcting the set rotational speed ($\Omega_r$) using the rotation correction signal to provide a corrected set rotational speed ($\omega_{r,cor}$) signal;

subtracting the measured rotational speed ($\omega_r$) from the corrected set rotational speed signal to provide a twice corrected set rotational speed ($\Omega_{r,2cor}$) signal to the drive system.

14. The method of claim 13, wherein the method is used to steer the drill bit to a drilling target within a hydrocarbon fluid containing formation and upon reaching the drilling target the borehole is converted into a hydrocarbon fluid production well from which hydrocarbon fluid is produced.

15. A steerable drilling system for drilling a borehole into an earth formation, comprising:

a drill string rotation modulation system configured to modulate a rotational speed of a drill string during each revolution thereof;

a Measuring While Drilling Device (MWD) configured to transmit repeated measurements of an orientation of a Bottom Hole Assembly (BHA) between a lower end of the drill string and a drill bit with a tilted toolface orientation to the modulation system to steer the drill bit in a desired direction;

wherein the MWD is configured to divide each revolution of the BHA into a plurality of angular intervals and to determine average percentages of time that the BHA rotates through the angular intervals to transmit information about the drill bit steering direction to the modulation system; and wherein in the drill string rotation modulation system each revolution of an upper portion of the drill string is divided into a plurality of angular sections, and the modulation of the rotation speed defines a primary function indicating average percentages of time that the upper drill string portion rotates through the angular sections.

16. The steerable drilling system of claim 15, wherein the average percentages of time that the BHA rotates through the angular intervals monitored by the MWD defines a secondary function, so that the primary and secondary functions can be compared with each other, and the modulation of the rotational speed of the drill string can be adjusted in dependence of a result of the comparison.

17. The steerable drilling system of claim 16, wherein the primary function is represented by parameters A, B and C, wherein parameter A defines a rotational position of the upper drill string portion at which the primary function is at a minimum, parameter B defines a difference between said minimum and a maximum of the primary function, and parameter C defines a rotation angle range of the upper drill string portion in which the primary function has a lower average value than in a remaining rotation angle of the upper drill string portion.

18. The steerable drilling system of claim 17, wherein the secondary function is represented by parameters P, Q and R, wherein parameter P defines a rotational position of the BHA at which the secondary function is at a minimum, parameter Q defines a difference between said minimum and a maximum of the secondary function, and parameter R defines a rotation angle range of the BHA in which the secondary function has a lower average value than in a remaining rotation angle of the BHA.

19. The steerable drilling system of claim 18, configured to allow at least one statistical characteristic to adjust modulation of the rotational speed of the drill string comprises adjusting parameter A in dependence of parameter P and/or adjusting parameter B in dependence of parameter Q and/or adjusting parameter C in dependence of parameter R.

* * * * *